US009350096B2

(12) United States Patent
Retho

(10) Patent No.: US 9,350,096 B2
(45) Date of Patent: May 24, 2016

(54) CONTACT MEMBER BETWEEN A SUBSTRATE AND A DEVICE AND ELECTRICAL CONNECTOR COMPRISING SUCH A CONTACT MEMBER

(71) Applicant: HYPERTAC SA, Saint-Aubin-les-Elbeuf (FR)

(72) Inventor: Patrice Retho, Elbeuf (FR)

(73) Assignee: HYPERTAC SA, Saint-Aubin-les-Elbeuf (FR)

( * ) Notice: Subject to any disclaimer, the term of this patent is extended or adjusted under 35 U.S.C. 154(b) by 0 days.

(21) Appl. No.: 14/447,510

(22) Filed: Jul. 30, 2014

(65) Prior Publication Data

US 2015/0037987 A1 Feb. 5, 2015

(30) Foreign Application Priority Data

Jul. 31, 2013 (FR) ..... 13 57601

(51) Int. Cl.

| | |
|---|---|
| ***H01R 12/52*** | (2011.01) |
| ***H01R 12/71*** | (2011.01) |
| ***H01R 13/03*** | (2006.01) |
| ***H01R 13/24*** | (2006.01) |

(52) U.S. Cl.

CPC ..... *H01R 12/714* (2013.01); *H01R 13/03* (2013.01); *H01R 13/245* (2013.01)

(58) Field of Classification Search

CPC .. H01R 23/722; H01R 13/03; H01R 13/2442; H01R 9/096; H01R 43/16; H01R 12/57; H01R 13/2435; H01R 12/52

See application file for complete search history.

(56) References Cited

U.S. PATENT DOCUMENTS

| | | | | |
|---|---|---|---|---|
| 4,449,165 | A * | 5/1984 | Kaufman | 361/723 |
| 4,666,226 | A * | 5/1987 | Legrand et al. | 439/592 |
| 4,980,245 | A * | 12/1990 | Marino | 428/671 |
| 5,350,322 | A * | 9/1994 | Kondo | 439/862 |
| 5,839,924 | A * | 11/1998 | Ritson | 439/757 |
| 6,641,410 | B2 * | 11/2003 | Marvin et al. | 439/83 |
| 6,860,746 | B2 * | 3/2005 | Ota et al. | 439/181 |
| 7,172,438 | B2 * | 2/2007 | Vicich et al. | 439/83 |
| 7,458,816 | B1 * | 12/2008 | Mathieu et al. | 439/66 |
| 7,773,388 | B2 * | 8/2010 | Kariya et al. | 361/776 |

(Continued)

FOREIGN PATENT DOCUMENTS

| | | | |
|---|---|---|---|
| DE | 10064137 | A1 | 7/2002 |
| DE | 102012216525 | A1 | 4/2013 |
| EP | 0413144 | A2 | 2/1991 |

OTHER PUBLICATIONS

Search Report in corresponding FR application No. 1357601 issued Mar. 24, 2014.

*Primary Examiner* — Gary Paumen

(74) *Attorney, Agent, or Firm* — Knobbe Martens Olson & Bear LLP

(57) ABSTRACT

A contact member establishes an electrical contact between a substrate and a first device. The contact member includes: a base extending substantially along a plane (P) and having a first surface that can be fixed on to the substrate, and a second surface (68) opposite the first surface along a normal direction (N) substantially perpendicular to the said plane. The second surface can be located face-to-face with the first device. At least one tongue can be integrally attached to the base. The tongue is flexible between a rest position, in which a distal end of the tongue is located at a distance away from the base on the side of the second surface along the normal direction, and a flexed position.

9 Claims, 3 Drawing Sheets

(56) References Cited

U.S. PATENT DOCUMENTS

| | | | | |
|---|---|---|---|---|
| 7,891,984 | B1 * | 2/2011 | Ju | 439/66 |
| 8,109,769 | B1 * | 2/2012 | Ismail et al. | 439/66 |
| 8,690,613 | B2 * | 4/2014 | Yoshida et al. | 439/862 |
| 8,784,146 | B2 * | 7/2014 | Yang et al. | 439/862 |
| 8,864,524 | B2 * | 10/2014 | Sato | 439/630 |
| 8,911,242 | B2 * | 12/2014 | Jeon et al. | 439/66 |
| 2002/0049008 | A1 * | 4/2002 | Saito et al. | 439/886 |
| 2003/0173107 | A1 * | 9/2003 | Smith et al. | 174/256 |
| 2004/0018782 | A1 * | 1/2004 | Antaya et al. | 439/862 |
| 2006/0046529 | A1 * | 3/2006 | McKnight et al. | 439/66 |
| 2006/0057905 | A1 * | 3/2006 | McGill et al. | 439/886 |
| 2006/0105640 | A1 * | 5/2006 | Vance | 439/862 |
| 2007/0141863 | A1 * | 6/2007 | Williams | 439/66 |
| 2007/0245553 | A1 * | 10/2007 | Chong et al. | 29/843 |
| 2007/0298626 | A1 * | 12/2007 | Hougham et al. | 439/66 |
| 2009/0325398 | A1 * | 12/2009 | Ma et al. | 439/66 |
| 2010/0144216 | A1 * | 6/2010 | Daniel et al. | 439/862 |
| 2011/0009015 | A1 * | 1/2011 | Yoshida et al. | 439/886 |
| 2011/0294368 | A1 * | 12/2011 | Nakata et al. | 439/887 |
| 2013/0029500 | A1 * | 1/2013 | Fan et al. | 439/66 |
| 2013/0072075 | A1 * | 3/2013 | Kayamoto | 439/887 |
| 2014/0170912 | A1 * | 6/2014 | Ando et al. | 439/862 |

* cited by examiner

CONTACT MEMBER BETWEEN A SUBSTRATE AND A DEVICE AND ELECTRICAL CONNECTOR COMPRISING SUCH A CONTACT MEMBER

CROSS-REFERENCE TO RELATED APPLICATION

This application claims priority to French Patent Application No. 13 57601 filed on Jul. 31, 2013, the disclosure of which including the specification, the drawings, and the claims is hereby incorporated by reference in its entirety.

BACKGROUND OF THE INVENTION (1) Field of the Invention

The present invention relates to a contact member intended for establishing an electrical contact between a substrate having a first electrical circuit and a first device that has a second electrical circuit, the contact member comprising:

- a base extending substantially along a plane and having a first surface intended to be fixed on to the substrate, and a second surface opposite the first surface along a normal direction substantially perpendicular to the said plane, the second surface being intended to be located face to face with the first device, and
- at least one tongue attached to the base and intended to be in electrical contact with the second electrical circuit, the tongue being flexible between a rest position, in which a distal end of the tongue is located at a distance away from the base on the side of the second surface along the normal direction, and a flexed position intended to be occupied when the tongue is in contact with the first device and in which the distal end is closer to the base along the normal direction than in the rest position.

The invention also relates to an electrical connector comprising of a substrate and at least one such contact member.

(2) Description of Related Art

The electrical connector is for example an interposer designed for electrically connecting two devices having electrical circuits.

Such contact members must possess excellent electrical properties, for example in terms of the transmission of high frequency signals and in terms of low contact resistance.

It has been observed in addition, that there is a trend towards the miniaturisation of such contact members. However, taking into account this miniaturisation, the securing of such contact members on the substrate is increasingly more difficult.

One object of the invention is therefore to provide a contact member intended for establishing electrical contact between a substrate having a first electrical circuit and a device having a second electrical circuit that is easy to attach on to the substrate, while also maintaining good electrical properties for transmission of signals.

BRIEF SUMMARY OF THE INVENTION

To this end, the invention relates to a contact member as described here above, in which:

- the base is of a larger dimension that is less than or equal to 1 mm, and
- the second surface includes a gripping surface of generally rectangular or square shape having a short side and a long side, the gripping surface extending over at least 0.01 $mm^2$, and the short side having a length greater than or equal to 0.1 mm.

According to particular embodiments, the contact member comprises one or more of the following characteristic features, considered individually or in accordance with any technically possible combination:

- the base presents, at all points of the gripping surface, a thickness along the normal direction of less than or equal to 0.25 mm;
- the tongue is adapted so that the distal end moves off by at least 0.07 mm towards the base along the normal direction when a force of 0.25 newtons is applied to the distal end along the normal direction;
- the base and the tongue form a plate comprising a first layer substantially parallel to the plane and composed of a metal alloy containing copper in a proportion of at least 50% by weight, the plate preferably including a second layer situated on the first layer on the side of the second surface, and a third layer situated on the first layer on the side of the first surface, the second layer and the third layer containing nickel, or a nickel alloy in a proportion of at least 50% by weight;
- the plate further comprises a first coating forming the second surface, the first coating being composed of gold, or a gold alloy in a proportion of at least 90% by weight, the plate preferably having a second coating forming the first surface, the second coating being composed of tin, or a tin alloy in a proportion of at least 30% by weight, or gold, or a gold alloy in a proportion of at least 90% by weight;
- the base has an orifice, the tongue projecting out from a first edge of the orifice towards a second edge of the orifice, the first edge being located on the other side of the second edge relative to the gripping surface along a second longitudinal direction substantially parallel to the plane, the tongue being configured in a manner such as to partially close off the orifice as viewed along the normal direction;
- as viewed along the normal direction, the orifice and the tongue define a form that is substantially "U" or "C" shaped, the base of the "U" or "C" being turned towards the gripping surface, the tongue defining the interior the "U" or C.

The invention also relates to an electrical connector comprising a substrate having a first electrical circuit, the connector being intended to be connected to a first device having a second electrical circuit, the connector comprising at least one contact member as described here above, the first surface of the contact member being fixed on to the substrate.

According to particular embodiments, the electrical connector comprises one or more of the following characteristic features, considered individually or in accordance with any technically possible combination:

- the substrate comprises at least one via, and a receiving pad substantially parallel to the plane and electrically connected to the via, the first surface of the contact member being welded on to the receiving pad at least face to face with the gripping surface;
- the receiving pad has a general shape of a "U" or "C, the gripping surface of the contact member is situated in the base of the "U" or "C" of the receiving pad as projected on to the plane, the two legs of the "U" or "C" are respectively welded on to two lateral portions of the base located on either side of the orifice along a second transverse direction substantially perpendicular to the normal direction.

BRIEF DESCRIPTION OF THE SEVERAL VIEWS OF THE DRAWING(S)

The invention will be better understood upon reviewing the description that follows, given purely by way of example and with reference being made to the accompanying drawings, in which.

DETAILED DESCRIPTION OF THE INVENTION

Figure 1:
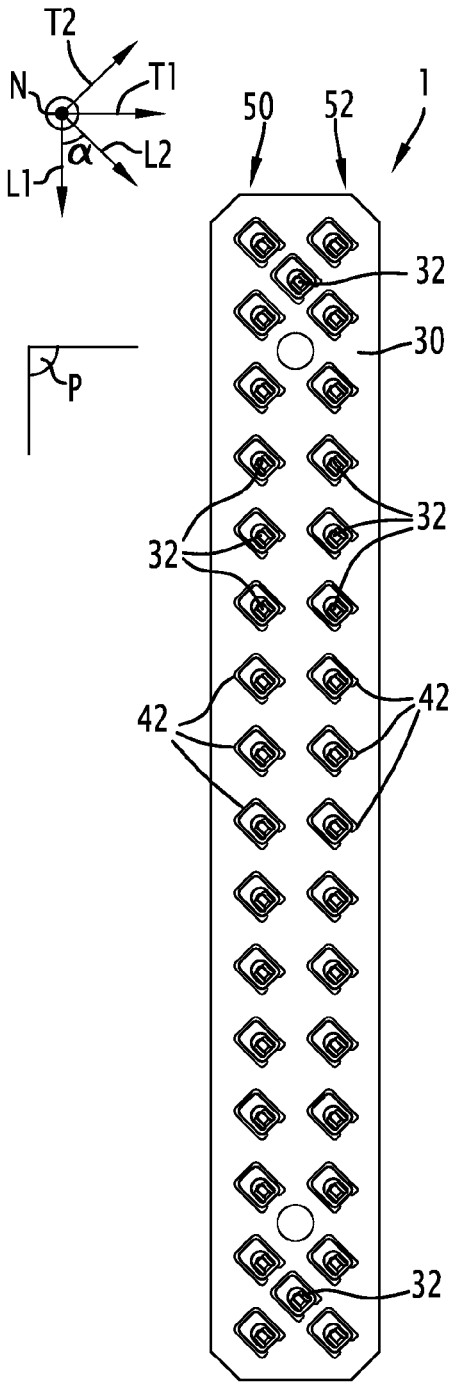
FIG. 1 is a front view of a connector according to the invention.
Figure 2:
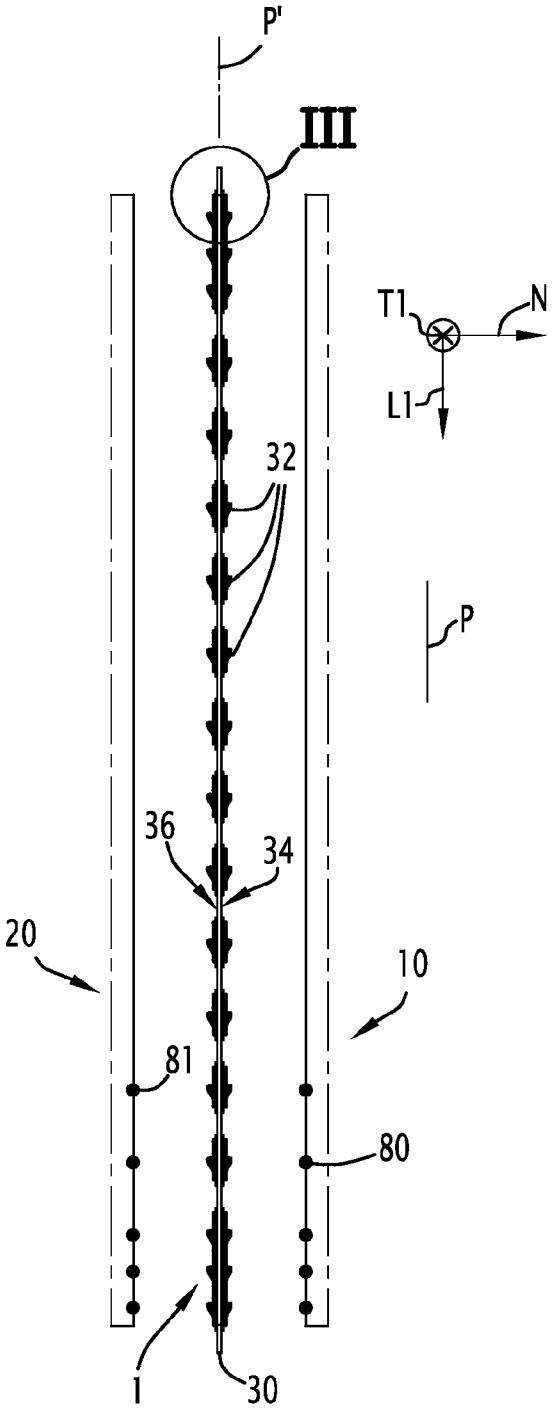
FIG. 2 is a side or profile view of the connector shown in FIG. 1.

With reference to FIGS. 1 and 2, a connector 1 intended for establishing electrical contact between a first device 10 and a second device 20 is described. Such an electrical connector 1 is sometimes referred to as an "interposer."

The electrical connector 1 comprises a substrate 30 extending substantially along a plane P, and a plurality of contact members 32 attached on to the substrate 30.

The substrate 30 is for example substantially planar. It has a general shape that is substantially rectangular and projected on the plane P. The general shape of the substrate 30 is elongated along a first longitudinal direction L1 parallel to the plane P.

Also defined are a normal direction N that is substantially perpendicular to the plane P, and a first transverse direction T1 that is substantially perpendicular to the first longitudinal direction and substantially perpendicular to the normal direction N.

The substrate 30 has a first face 34 (FIG. 2) intended to be positioned face to face with the first device 10, and a second face 36 opposite to the first face 34 along the normal direction N intended to be positioned face to face with the second device 20.

According to a particular embodiment (not shown), the substrate 30 is a printed circuit.

Figure 3:
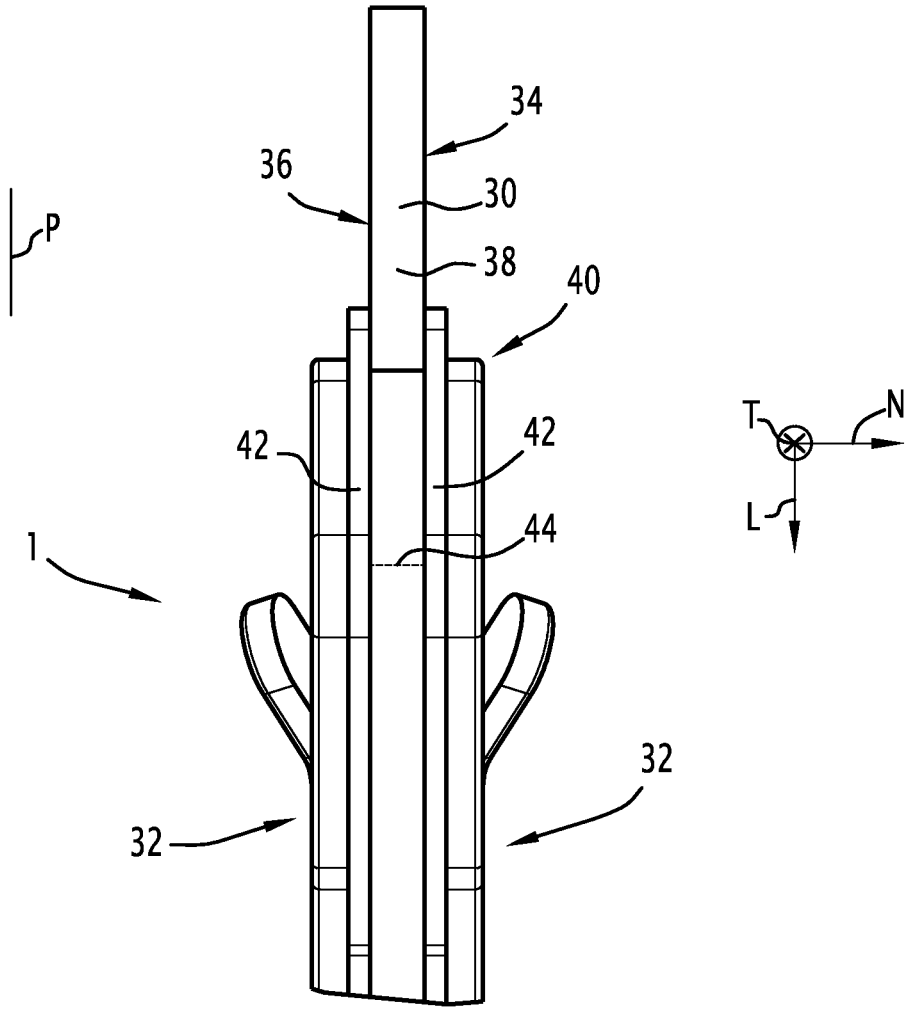
FIG. 3 is a detail view of the upper end of the connector shown in FIG. 2.

As is visible in FIG. 3, the substrate 30 comprises a plate 38, and a first electrical circuit 40.

The plate 38 is for example made out of Kapton or FR-4 covered with a layer of copper. The copper layer is etched so as to make visible one or more desired electrical circuits.

The first electrical circuit 40 comprises of a plurality of receiving pads 42 arranged on the first face 34 and the second face 36, for example symmetrically in relation to a median plane P' of the substrate 30. In the example represented, the first electrical circuit 40 further comprises a plurality of via 44 extending along the normal direction N.

Each via 44 is defined by a bore made in the plate 38, and then metallised.

The via 44 electrically connect, on a two by two basis, the receiving pads 42 symmetrically relative to the median plane P'.

The receiving pads 42 are for example made out of a tin/lead alloy. The receiving pads 42 respectively receive the contact members 32. The receiving pads 42 are substantially parallel to the plane P. The receiving pads 42 have for example a general form shaped like a "U", with the legs of the "U" extending along a second longitudinal direction L2 substantially parallel to the plane P.

According to variants that are not represented, the receiving pad 42 has a general form shaped like a "C" or filled rectangle or disk.

As is visible in FIG. 1, the second longitudinal direction L2 advantageously forms with the first longitudinal direction L1 an angle $\alpha$ ranging between 40° and 50°. The angle $\alpha$ is for example about 45°.

Also defined additionally is a second transverse direction T2 substantially perpendicular to the second longitudinal direction L2 and substantially perpendicular to the normal direction N.

On each of the first face 34 and the second face 36 of the substrate 30, the plurality of contact members 32 define two rows 50, 52 (FIG. 1) oriented substantially along the first longitudinal direction L1. In addition, two additional contact members 32 relative to the rows 50, 52 are respectively located at two ends of the substrate 30 along the first longitudinal direction L1.

The two additional contact members 32 are substantially at equal distance from the two rows 50, 52 along the first transverse direction T1.

The contact members 32 being similar to each other, only one of them, situated on the first face 34 of the substrate 30, shall be described here below with reference being made to FIGS. 4 and 5.

Figure 4:
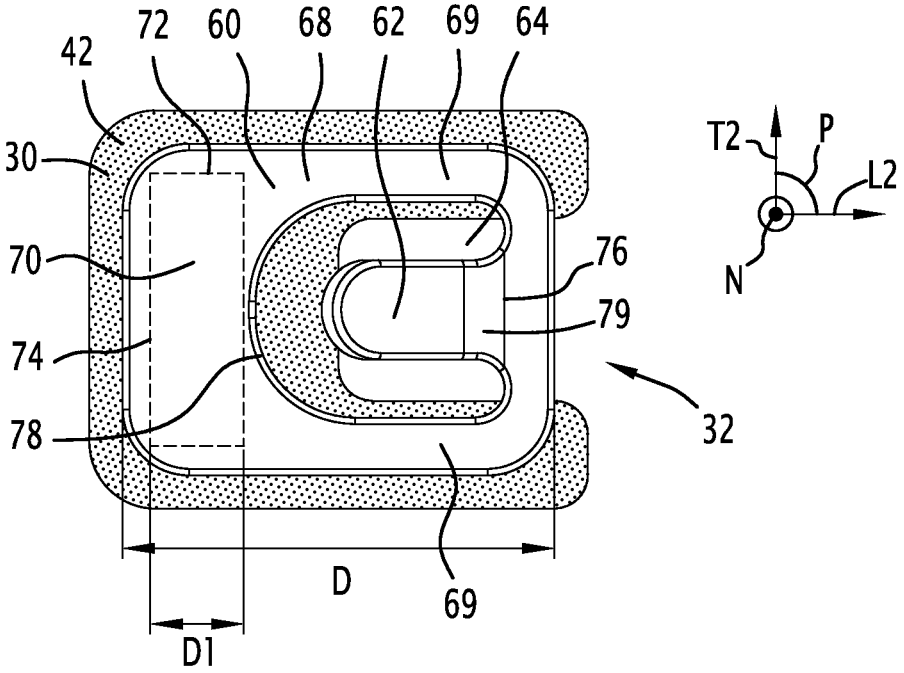
FIG. 4 is a front view of a contact member and a receiving pad of the substrate shown in FIGS. 1 to 3.
Figure 5:
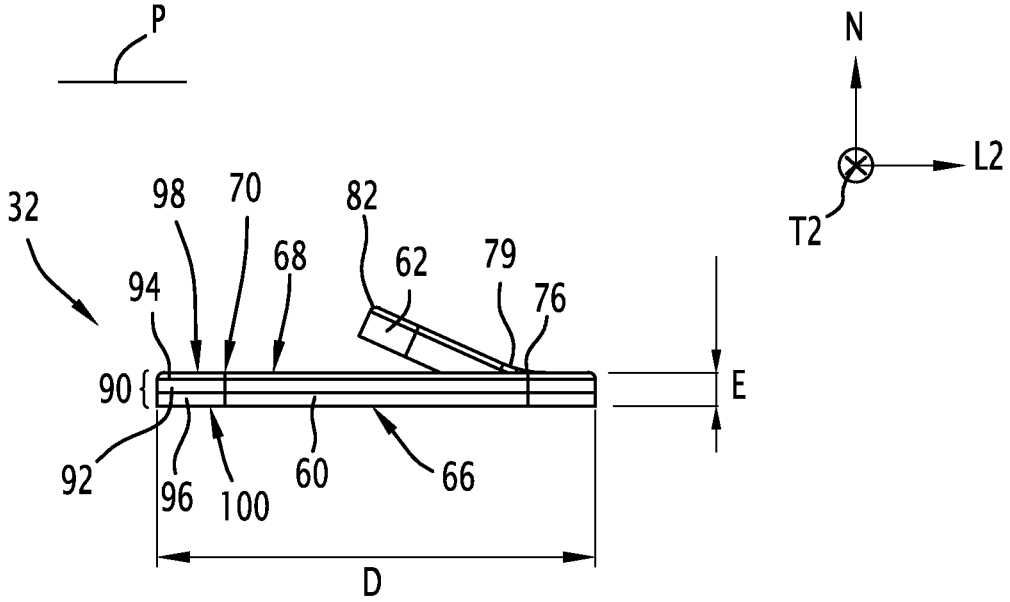
FIG. 5 is a side or profile view of the contact member shown in FIG. 4.

The contact member 32 shown in FIGS. 4 and 5 comprises a base 60 extending substantially along the plane P, and at least one tongue 62 integrally attached to the base 60. The base 60 further includes an orifice 64 along the normal direction N.

The base 60 has a generally rectangular shape. The base 60 is of a larger dimension D that is less than or equal to 1 mm, for example ranging between 0.4 and 0.8 mm. For example, the larger dimension D extends along the second longitudinal direction L2.

The base 60 has a first surface 66 attached on to one of the receiving pads 42 of the first face 34 of the substrate 30, and a second surface 68 opposite the first surface along the normal direction N and situated face to face with the first device 10.

The base 60 further comprises two lateral portions 69 located on either side of the orifice 64 along the second transverse direction T2.

The first surface 66 and the second surface 68 are for example substantially parallel to the plane P (FIG. 5).

The second surface 68 includes a gripping surface 70 of generally rectangular or square shape.

The gripping surface 70 is situated in the base of the "U" formed by the receiving pad 42 as projected on the plane P (FIG. 4). The gripping surface 70 possesses a short side 72 and a long side 74 (FIG. 4). The gripping surface extends over at least 0.01 $mm^2$ The short side 72 extends for example along the second longitudinal direction L2. The short side 72 has a length D1 that is greater than or equal to 0.1 mm, preferably greater than or equal to 0.2 mm.

The lateral portions 69 of the base 60 are located, as projected on to the plane P, in the legs of the "U" formed by the receiving pad 42.

The base 60 presents, at all points of the gripping surface 70, a thickness E (FIG. 4) along the normal direction N of less than or equal to 0.25 mm.

The tongue 62 projects out from a first edge 76 of the orifice 64 towards a second edge 78 of the orifice 64. The tongue 62 is configured in a manner such as to partially close off the orifice 64 as viewed along the normal direction N.

The tongue 62 has a proximal end 79 located, as projected on to the plane P, on the exterior of the receiving pad 42.

The tongue 62 is intended to be in electrical contact with a second electrical circuit 80 of the first device 10. In similar fashion, the tongue 62 of the contact members 32 located on the second face 36 of the substrate 30 is intended to be in electrical contact with a third electrical circuit 81 of the second device 20.

The tongue 62 is flexible between a rest position, shown FIGS. 4 and 5, in which a distal end 82 of the tongue 62 is located at a distance away from the base 60 on the side of the second surface 68 along the normal direction N, and a flexed position (not shown) intended to be occupied when the distal end 82 is in contact with the first device 10 and in which the distal end 82 is closer to the base 60 along the normal direction N than in the rest position.

The tongue 62 is adapted so that the distal end 82 moves off by at least 0.07 mm toward the base 60 along the normal direction N when a force of 0.25 newtons is applied to the distal end 82 along the normal direction N.

In the rest position, the distal end 82 of the tongue 62 is located at a distance of about 0.15 mm from the first surface 66 of the base 60 along the normal direction N. The distal end 82 advantageously occupies a substantially central position relative to the base 60 as projected along the normal direction N.

As viewed along the normal direction N, the orifice 64 and the tongue 62 define an opening that is substantially "U" shaped. The base of the "U" is advantageously turned towards the gripping surface 70, with the tongue 62 forming the inside of the U.

In the rest position, the tongue 62 is located at a distance away from the receiving pad 42 on which is located the contact member 32, in a manner such that there is no direct electrical contact between the tongue 62 and the receiving pad 42.

The first edge 76 of the orifice 64 is located on the other side of the second edge 78 relative to the gripping surface 70 along the second longitudinal direction L2.

The base 60 and the tongue 62 form a plate 90 comprising a first layer 92 substantially parallel to the plane (P), a second layer 94 situated on the first layer 92 on the side of the second surface 68 of the base 60, and a third layer 96 situated on the first layer on the side of the first surface 66.

The plate 90 (FIG. 5) further comprises a first coating 98 forming the second surface 68, and a second coating 100 forming the first surface.

The first layer 92 is composed of a metal alloy containing copper in a proportion of at least 50% by weight.

The second layer 94 and the third layer 96 contain nickel or a nickel alloy, in a proportion of at least 50% by weight.

The first coating 98 is composed of gold or a gold alloy in a proportion of at least 90% by weight.

The second coating 100 is composed of tin, or a tin alloy in a proportion of at least 40% by weight, or gold, or a gold alloy in a proportion of at least 90% by weight.

The operation of the connector 1 and of each contact member 32 shall now be described.

The connector 1 is interposed between the first device 10 and the second device 20 (FIG. 2). The contact members 32 located on the first face 34 of the substrate 30 are brought into electrical contact with the second circuit 80 by means of their tongue 62. In similar fashion, the contact members 32 located on the second face 36 are brought into contact with the third circuit 81 by means of their tongue 62.

While being brought into electrical contact, the tongues 62 of the contact members 32 move from the rest position into the flexed position.

The electrical contact between the second electrical circuit 80 and the third electrical circuit is brought about successively by the tongue 62 of one of the contact members 32 located on the first face 34 of the substrate 30, and then by the base 60 of the said contact member 32, then by the receiving pad of 42 on which the said contact member 32 is fixed, then by one of the via's 44 (FIG. 3), then by the receiving pad 42 located on the second face 36 of the substrate 30 and symmetrical with the preceding one relative to the plane P', then by the base 60 of the contact member 32 located on the second face 36 and symmetrical with the preceding one relative to the plane P', and finally by the tongue 62 of the contact member 32.

A method for manufacturing the connector 1 shall now be described.

A first step consists of producing a large sheet (not shown) meant to be cut so as to form the plate 90. In order to do this, a layer equivalent to the second layer 94 and a layer equivalent to the third layer 96 are deposited on to a layer equivalent to the first layer 92.

The coatings 98, 100 are then deposited.

The orifices are formed in the large plate in order to define the orifice 64 and the tongue 62 of each contact member 32. Then the large plate is cut out in a manner such as to form the periphery of the base 60 for several contact members 32.

Each tongue 62 is bent slightly at the level of its proximal end 79 in order to set to each tongue 62 in the rest position.

This process makes it possible to produce a plurality of contact members 32 by cutting them from the large sheet.

By way of a variant, the depositing of coatings 98, 100 takes place after the cutting out of each contact member 32.

The production of the substrate 30 is a process known in itself and shall not be described in detail.

The contact members 32 are placed on the receiving pads 42 by making use of a suction nozzle (not shown) which is applied on the gripping surface 70. By means of a suction effect, the contact member 32 remains adhered to the tip of the suction nozzle. The contact member 32 is then easily placed on the receiving pad 42 with the aid of the gripping surface 70 through a movement of the suction nozzle. Each contact member 32 is subsequently welded on to the substrate 30 by means of brazing of the connector 1 in a furnace (not shown) according to a method that is known in and of itself.

According to a variant, the connector 1 is not placed in an oven. Two electrodes (not shown) are placed on the gripping surface 70 in order to enable the flow of a current in the base 60. This heats the base 60 of the contact member 32 and the receiving pad 42 and causes the soldering of the base 60 on to the receiving pad 42.

Thanks to the characteristic features described here above, in particular the gripping surface 70, the contact member 32, which establishes the electrical contact between the substrate 30 and the first device 10, is easy to place and attach on to the substrate 30, while at the same time maintaining good electrical properties for transmission of signals.

In particular, the contact member 32 is adapted to be able to fully transmit electrical signals up to a frequency of 18 GHz.

The electrical resistance measured between the distal ends 82 of the two tongues 62 belonging to the two contact members 32 located face to face with one another along the normal direction N is preferably less than 20 mΩ.

What is claimed is:

1. An electrical connector comprising a substrate having a first electrical circuit, the connector being intended to be connected a first device having a second electrical circuit, the connector comprising at least one contact member establishing an electrical contact between said substrate and said first device, the contact member comprising:

a base extending substantially along a plane and having a first surface fixed on to the substrate, and a second surface opposite the first surface along a normal direction substantially perpendicular to the said plane, the second surface being intended to be located face to face with the first device, and at least one tongue attached to the base and intended to be in electrical contact with the second electrical circuit, the tongue being flexible between a rest position, in which a distal end of the tongue is located at a distance away from the base on the side of the second surface along the normal direction, and a flexed position intended to be occupied when the tongue is in contact with the first device and in which the distal end is closer to the base along the normal direction than in the rest position, wherein:

a largest dimension of the base is less than or equal to 1 mm, and the second surface includes a gripping surface of generally square or rectangular shape having a short side and a long side, the gripping surface extending over at least 0.01 $mm^2$, and the short side having a length greater than or equal to 0.1 mm, wherein the substrate comprises at least one via and a receiving pad substantially parallel to the plane and electrically connected to the via, the first surface of the contact member being welded on to the receiving pad at least face to face with the gripping surface, and wherein the substrate com s rises at least one via and a receiving pad substantially parallel to the plane and electrically connected to the via, the first surface of the contact member being welded on to the receiving pad at least face to face with the gripping surface.

2. The electrical connector according to claim 1, wherein the base presents, at all points of the gripping surface, a thickness along the normal direction of less than or equal to 0.25 mm.

3. The electrical connector according to claim 1, wherein the tongue is adapted so that the distal end moves off by at least 0.07 mm towards the base along the normal direction when a force of 0.25 newtons is applied to the distal end along the normal direction.

4. The electrical connector according to claim 1, wherein the base and the tongue form a plate comprising a first layer substantially parallel to the plane and composed of a metal alloy containing copper in a proportion of at least 50% by weight, the plate preferably including a second layer situated on the first layer on the side of the second surface, and a third layer situated on the first layer on the side of the first surface, the second layer and the third layer containing nickel, or a nickel alloy in a proportion of at least 50% by weight.

5. The electrical connector according to claim 1, wherein the plate further comprises a first coating forming the second surface, the first coating being composed of gold, or a gold alloy in a proportion of at least 90% by weight, the plate preferably having a second coating forming the first surface, the second coating being composed of tin, or a tin alloy in a proportion of at least 30% by weight, or gold, or a gold alloy in a proportion of at least 90% by weight.

6. The electrical connector according to claim 5, wherein the plate comprises a second coating forming the first surface, the second coating being composed of tin, or a tin alloy in a proportion of at least 30% by weight, or gold, or a gold alloy in a proportion of at least 90% by weight.

7. The electrical connector according to claim 1, wherein the base has an orifice, the tongue projecting out from a first edge of the orifice towards a second edge of the orifice, the first edge being located on the other side of the second edge relative to the gripping surface along a second longitudinal direction substantially parallel to the plane, the tongue being configured in a manner such as to partially close off the orifice as viewed along the normal direction.

8. The electrical connector according to claim 1, wherein, as viewed along the normal direction, the orifice and the tongue define a form that is substantially "U" or "C" shaped, the base of the "U" or "C" being turned towards the gripping surface, the tongue defining the interior of the "U" or "C".

9. A method of establishing an electrical contact between a substrate having a first electrical circuit and a first device that has a second electrical circuit, the method comprising:

providing a contact member according to claim 1;

fixing the first surface to the substrate;

locating the second surface to be face-to-face with the first device, and flexing the tongue between the rest position and the flexed position so as to place the tongue in electrical contact with the second electrical circuit.

* * * * *